US006105193A

United States Patent [19]

Williams et al.

[11] Patent Number: 6,105,193

[45] Date of Patent: Aug. 22, 2000

[54] SCRUBBING AND MOPPING APPARATUS WITH POSITIVE ATTACHMENT OF MOP TO CARRIER BLOCK

[75] Inventors: Todd A. Williams, Aliso Viejo; Richard A. Williams, La Quinta, both of Calif.

[73] Assignee: S.C. Johnson Commercial Markets, Inc., Sturtevant, Wis.

[21] Appl. No.: 09/236,704

[22] Filed: Jan. 25, 1999

Related U.S. Application Data

[63] Continuation-in-part of application No. 08/964,154, Nov. 6, 1997, Pat. No. 5,964,005.

[51] Int. Cl.[7] ..... A47L 13/12

[52] U.S. Cl. ..... 15/115; 15/118

[58] Field of Search ..... 15/147.1, 150, 15/151, 152, 153, 115

[56] References Cited

U.S. PATENT DOCUMENTS

| | | | |
|---|---|---|---|
| 275,294 | 4/1883 | Titus | 15/150 |
| D. 358,487 | 5/1995 | Kneesch et al. . | |
| 377,955 | 2/1888 | O'Blenus . | |
| 399,223 | 3/1889 | Varney . | |
| 512,543 | 1/1894 | Froberg | 15/150 |
| 701,657 | 6/1902 | Wilson | 15/115 |
| 702,998 | 6/1902 | Randolph . | |
| 729,581 | 6/1903 | Held . | |
| 732,742 | 7/1903 | Held | 15/115 |
| 732,743 | 7/1903 | Held . | |
| 798,532 | 8/1905 | Sanders . | |
| 937,007 | 10/1909 | McLaughlin . | |
| 981,756 | 1/1911 | Glancey . | |
| 1,067,570 | 7/1913 | Ziegler . | |
| 1,171,161 | 2/1916 | Wingender | 15/150 |
| 1,171,768 | 2/1916 | Browning . | |
| 1,221,606 | 4/1917 | Sadler . | |
| 1,331,477 | 2/1920 | Albin . | |
| 1,589,253 | 6/1926 | Smiechewicz . | |
| 1,643,878 | 9/1927 | Crouch | 15/228 |
| 1,748,202 | 2/1930 | Bloomfield . | |
| 2,065,407 | 12/1936 | Steuernagel | 15/151 |
| 2,113,148 | 10/1938 | Paul . | |
| 2,518,765 | 8/1950 | Ecker . | |
| 2,568,218 | 9/1951 | Campbell | 15/150 |
| 2,641,787 | 6/1953 | Vosbikian et al. . | |
| 2,678,458 | 5/1954 | Vosbikian et al. . | |
| 2,683,886 | 7/1954 | Neumann . | |
| 2,701,888 | 2/1955 | Vosbikian et al. . | |
| 2,712,144 | 7/1955 | Dunn | 15/151 |
| 3,157,901 | 11/1964 | Murphy . | |
| 3,167,798 | 2/1965 | Dryden . | |
| 3,906,580 | 9/1975 | Smith et al. . | |
| 3,964,121 | 6/1976 | Kim . | |
| 4,802,782 | 2/1989 | Scalf . | |
| 5,435,852 | 7/1995 | Robinson . | |
| 5,522,110 | 6/1996 | Borofsky . | |
| 5,584,091 | 12/1996 | Borofsky . | |
| 5,724,696 | 3/1998 | Di Gaimmarino | 15/150 |
| 5,918,340 | 7/1999 | Young | 15/150 |
| 5,964,005 | 10/1999 | Williams et al. | 15/115 |

FOREIGN PATENT DOCUMENTS

| | | |
|---|---|---|
| 737140 | 6/1966 | Canada . |
| 1309326 | 10/1962 | France . |

*Primary Examiner*—Terrence R. Till
*Attorney, Agent, or Firm*—William W. Haefliger

[57] ABSTRACT

An apparatus for scrubbing and mopping a surface, comprising in combination, a supporting carrier, including a block and scrubbing media carried by the carrier, to project toward the surface for scrubbing that surface; first structure for attaching an elongated handle to the carrier to extend in a first direction from the carrier; and second manually manipulable structure for attaching a mop to the carrier, with mop strands extending in generally parallel relation with that surface and in mopping contact therewith, as the scrubbing media simultaneously engages that surface, for simultaneous mopping and scrubbing of that surface, as the handle extends at an angle to the surface to displace the carrier, bristles and mop parallel to the surface, and to transmit downward force to the scrubbing means; structure including a transversely lengthwise extending bar, about which a portion of the mop extends; and there being at least one projection on the carrier for engaging the mop to block bodily movement of said mop portion transversely lengthwise of the bar.

21 Claims, 6 Drawing Sheets

SCRUBBING AND MOPPING APPARATUS WITH POSITIVE ATTACHMENT OF MOP TO CARRIER BLOCK

This application is a continuation-in-part of prior U.S. patent application Ser. No. 08/964,154, filed Nov. 6, 1997, now U.S. Pat. No. 5,969,005.

BACKGROUND OF THE INVENTION

This invention relates generally to treatment such as cleaning of surfaces, and more particularly, to improvements in apparatus for scrubbing and mopping of surfaces by force application, as via an elongated handle.

Many surfaces to be cleaned contain interstices, cracks or crevices, in which dirt particles become embedded, or otherwise build up. Examples are cracks between tiles forming tiled surfaces, cracks and crevices in marble, clay, concrete, or synthetic material flooring, and surface interstices in many different types of floors. It is extremely difficult to remove such embedded or built up dirt particles using conventional mopping apparatus and/or procedure. It becomes necessary to scrub such surfaces, using a brush or brushes having bristles that can reach and remove the embedded soil or dirt particles.

In the past, it was known to provide for scrubbing and mopping of floor surfaces, using elongated handled equipment; however, such equipment lacked the unusually advantageous improvements in structure, functions and results, as are now enabled and produced by the present invention, and meeting needs for improved and more effective use and operation, as will appear.

SUMMARY OF THE INVENTION

It is a major object of the invention to provide improved method and apparatus meeting the above needs. Basically, the apparatus of the invention includes the following:

a) a supporting carrier, including a block and scrubbing means carried by the carrier, to project toward a surface to be cleaned, for scrubbing that surface, b) first means for attaching an elongated handle to the carrier to extend in a first direction from the carrier, c) and structure for attaching a mop to the carrier to extend in generally parallel relation with that surface and in mopping contact therewith as the scrubbing means simultaneously engages that surface, for mopping and scrubbing the surface simultaneously as the handle extends at an angle to the surface to displace the carrier, scrubbing means and mop parallel to the surface, d) said structure including a transversely lengthwise extending bar, about which a portion of the mop extends, e) and there being at least one projection on the carrier for engaging the mop to block bodily movement of said mop portion transversely lengthwise of the bar.

It is another object of the invention to provide such a device wherein the mop has a head attached by the bar to the carrier proximate a first side of the carrier, which extends laterally to provide support and stability for both the mop and the scrubbing means.

It is another object to provide a device, as referred to, wherein the handle is attached to the carrier at a second side of the carrier, typically spaced from the location of mop head attachment to the carrier.

A further object is to provide manually manipulable structure in the form of a bar or bail carried by the carrier to adjustably swing into mop head clamping position.

Yet another object is to provide manually manipulable structure that includes an adjustable clamp for adjustably clamping the mop head and having a first position in which the mop head is removable from attachment to the carrier, and a second position in which the mop head is attached to the carrier. In this regard, the carrier block has projections which positively engage the mop head to lock it against lateral movement, during use of the mop.

A still further object includes provision of a bar or bail in the form of a lever having an over-center pivoted and retained position in which the mop head is positively clamped.

An additional object includes provision of bristles, or a scrub pad attached to the underside of the carrier block, as for example by VELCRO attachment, enabling removal and replacement.

The apparatus of the present invention can be used for cleaning floors with tough dirt, stuck litter and oil stains. The cleaning apparatus is especially suitable for cleaning industrial floors, such as the floors of restaurants' kitchens, which usually are made of clay or concrete, with rough and porous surfaces to protect slipping. Advantageously, the cleaning apparatus of the present invention can perform surface cleaning and scrubbing and/or brushing functions simultaneously and conveniently by providing a mop and scrubbing block being removably and adjustably installed in a single assembly.

These and other objects and advantages of the invention, as well as the details of an illustrative embodiment, will be more fully understood from the following specification and drawings, in which:

DRAWING DESCRIPTION

DETAILED DESCRIPTION

Figure 1:
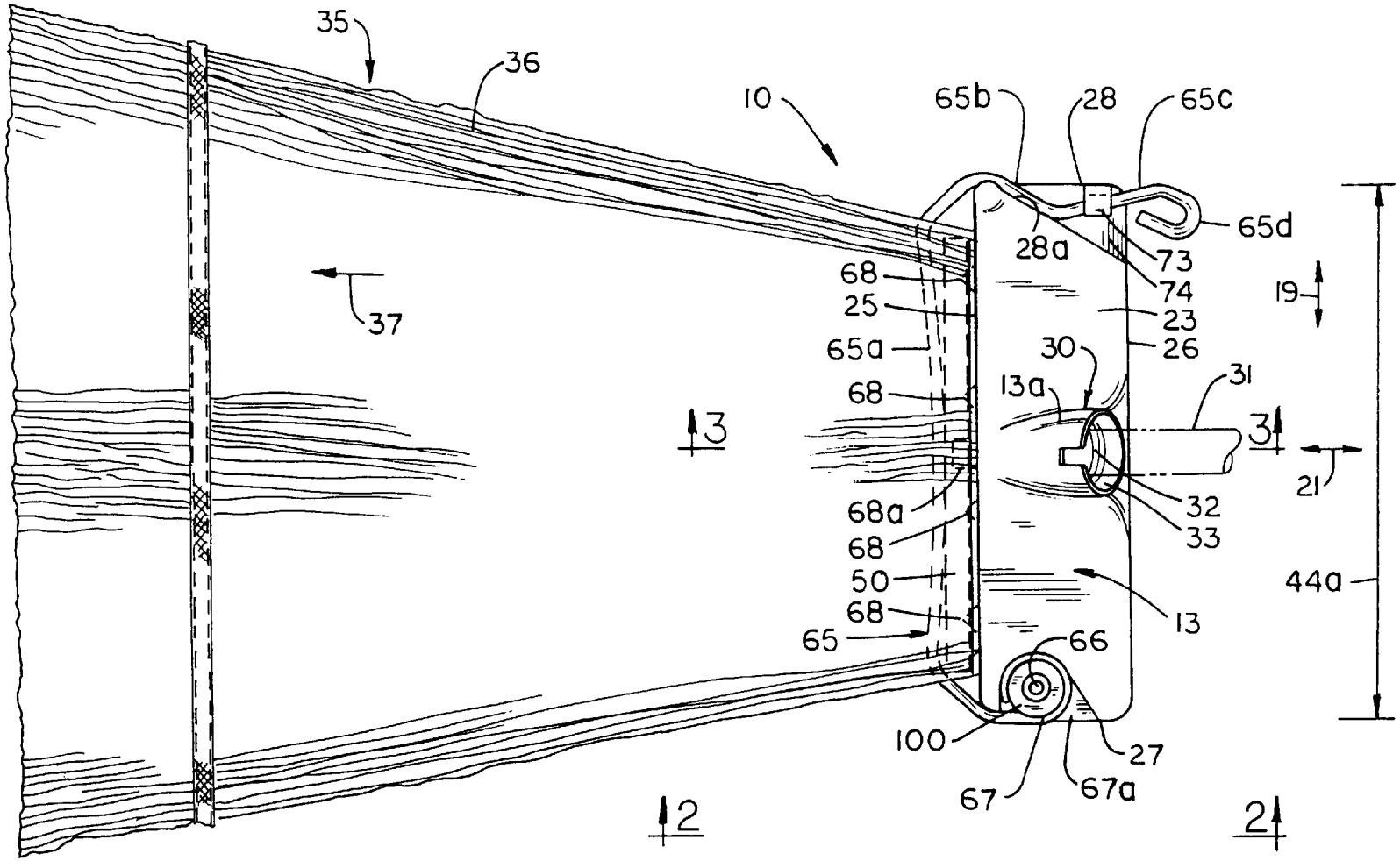
FIG. 1 is a top plan view of apparatus embodying the invention.
Figure 2:
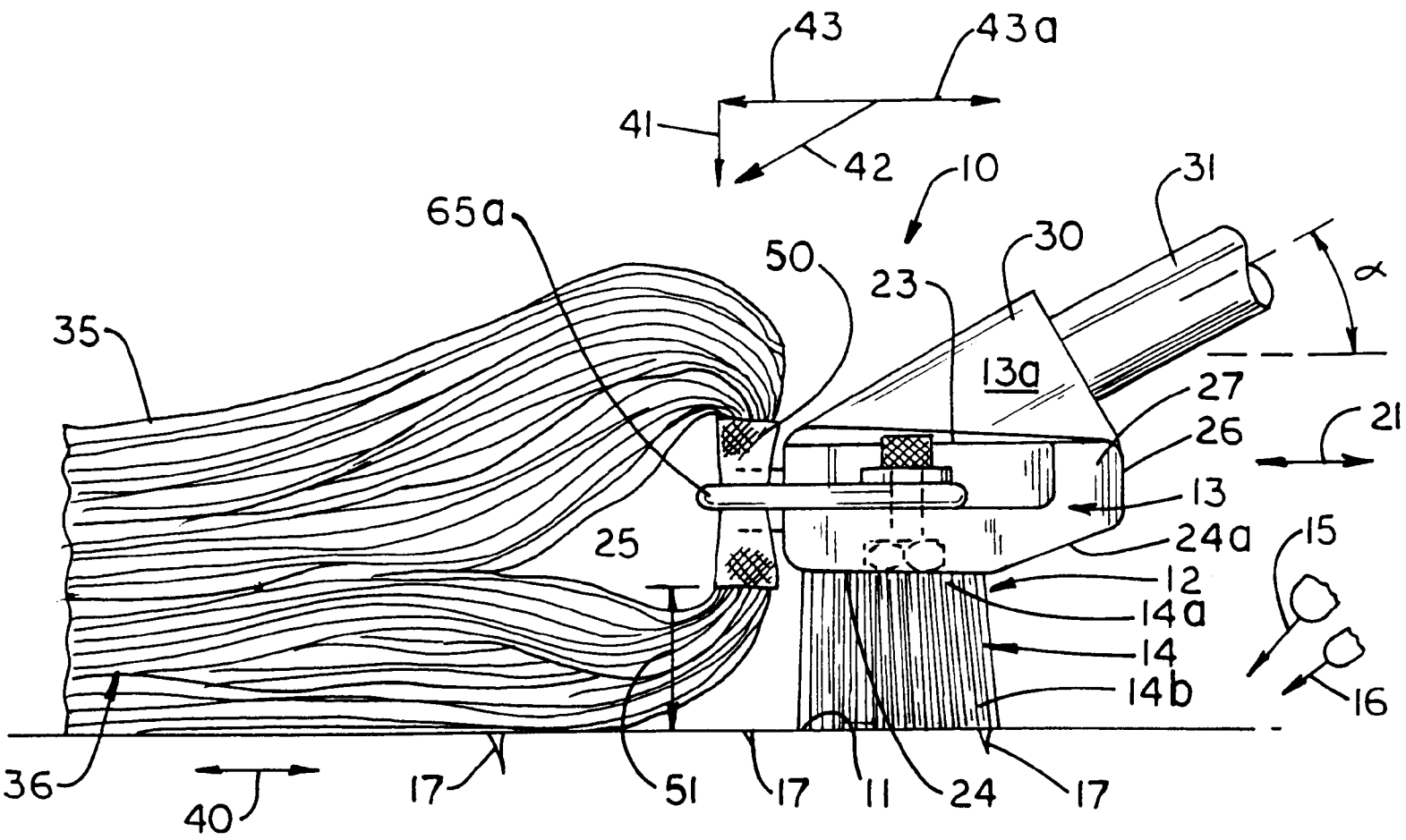
FIG. 2 is a side elevation taken on lines 2—2 of FIG. 1.

In FIGS. 1 and 2, a preferred form of the apparatus 10, for scrubbing and mopping a surface 11, such as a floor, is shown in operating position. The basic elements comprise a floor scrubbing means, one example of which is a scrub brush 12. The brush has bristles 14 having their upper ends 14*a* carried by the carrier 13 at its underside. The bristles project, as for example, downwardly as shown, toward the surface 11 in position for contacting that surface at bristle lower ends 14*b*.

Water and/or chemical cleaner may be applied to that surface, as at 15 and 16, to aid in bristle dislodgment of soils, grit and dirt particles from interstices and cracks in that surface. These are indicated at 17, and may take various forms.

Carrier 13 is typically laterally elongated in directions 19, as seen in FIG. 1, and relative to longitudinal direction 21. Carrier 13 may consist of molded plastic, or other material such as wood, and has an upper side 23, a bottom side 24 from which the bristles project, a front side 25, a rear side 26, and opposite ends 27 and 28. Side 25 may be perpendicular, or substantially perpendicular, to direction 21, and to the planes of upper and lower sides 23 and 24. Surface 24 may be beveled as at 24*a*, to facilitate rocking of the carrier, as during use.

First means is provided, as at 30, for attaching an elongated handle 31 to the carrier, to extend in a first direction from the carrier, which may have block shape. Such first means may, for example, include female screw threading at 32 formed in a recess 33 sunk downwardly and forwardly in a protrusion 13*a* at the carrier top side 23, mid-way between opposite ends 27 and 28. The lower end portion 31*a* of the handle may form or carry complementary male threading to rotatably attach to threading 32, whereby the handle is firmly connected to the carrier, to extend upwardly and rearwardly at an angle $\alpha$ relative to and above longitudinal direction or axis 21. Note handle axis 31*b* in FIG. 3.

A mop seen at 35 has flaccid strands 36 shown as extending forwardly of the front side 25 of the carrier in direction 37. Manually manipulable structure is provided for adjustable attaching the mop to the carrier 13, whereby the strands 36 extend in generally parallel relation with surface 11, the lower strands freely engaging that surface, for mopping same when the carrier 13 is moved frontwardly and rearwardly in directions 40, as seen in FIG. 2, and simultaneously with bristle scrubbing engagement with the surface, achieving simultaneous scrubbing and mopping of surface 11.

Accordingly, the downward component 41 of handle force 42 exerted on carrier 13 acts to push the bristles downwardly into and over the crevices, cracks and interstices 17 at the same time as the forward component 43 of handle force pushes or displaces the flaccid mop strands 36 forwardly, and subsequently the rearward component 43*a* of handle force pulls the strands 36 rearwardly over the interstices and cracks 17, to displace liquid into and from the crevices and cracks 17, carrying away or removing the bristle loosened soils and dirt. Fresh, aqueous liquid and/or cleaner is simultaneously mopped into the crevices or cracks to aid in loosening remanent soils and dirt, as the bristles are subsequently displaced forwardly again, with downward force component applicable at 41 to further or complete the soils and dirt loosening in the cracks and crevices filled with mopped liquid. The downwardly yieldable resilient spring aspect of the relatively stiff bristles assists in their penetration of the cracks and crevices under the influence of the downward force component 41.

The mop 35 has flaccid strand lateral dimension approximating or exceeding the lateral dimension 44*a* of the brush carrier, and bristles, whereby the simultaneous mopping and scrubbing effect, as described, is attained throughout the approximately equal lateral extents of the carrier and mop.

Further, attachment of the mop head or band 50 proximate the front side 25 of the carrier 13, above the level of the floor (see dimension 51 in FIG. 2) attains maximum proximity of the main extent of the mop to the floor 11, to enhance mopping and scrubbing effect, as described, while also facilitating direct, forward and rearward force transmission from the carrier to the mop head 50 and to the mop 35, for ease of required force transmission (push and pull) to the handle from the user's arm.

Figure 3:
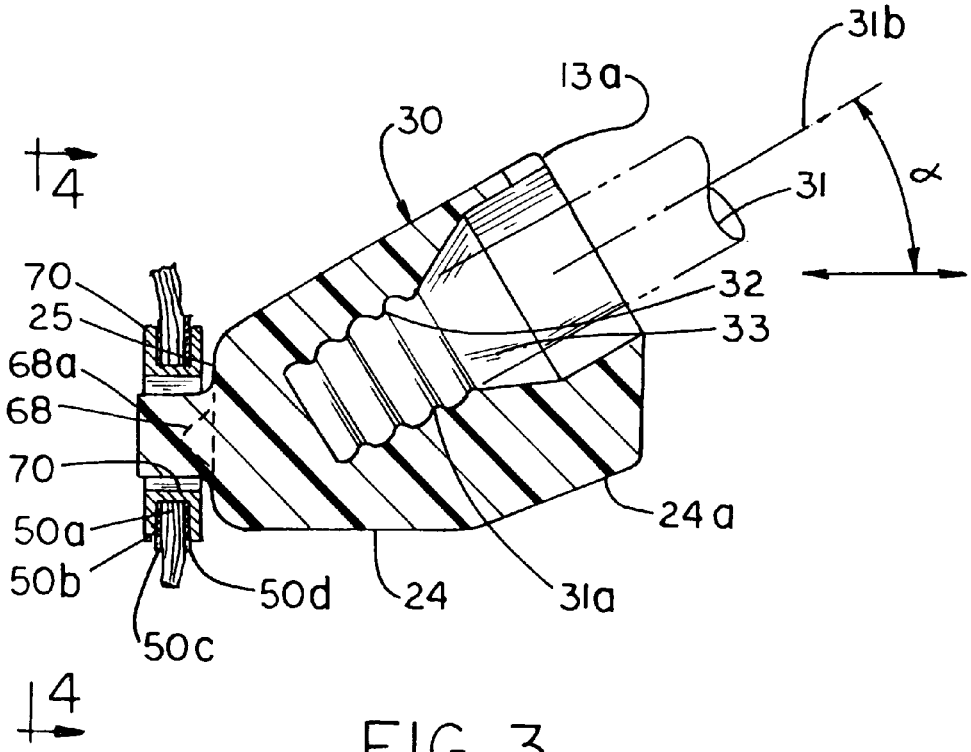
FIG. 3 is a section taken on lines 3—3 of FIG. 1.
Figure 4:
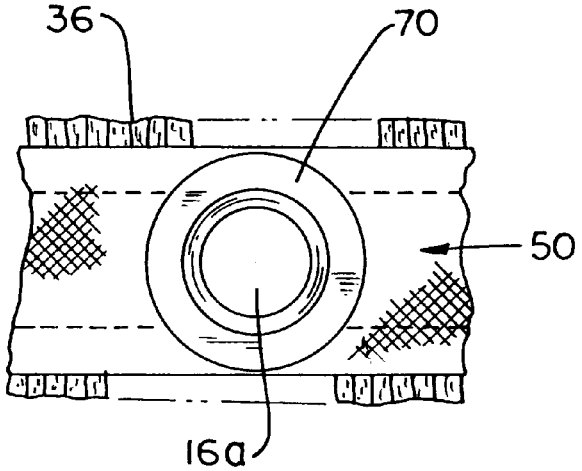
FIG. 4 is a fragmentary front elevation taken on lines 4—4 of FIG. 3.

The mop head 50 consists of a tightly gathered bundle of mop strand portions, which may be held clamped together, as at 50*a* by semi-rigid band 50*b*, having band forward and rearward extents 50*c* and 50*d* as seen in FIG. 3. The tight bundle also provides a semi-rigid support and holder for attachment of the mop head to the front side 25 of the carrier 13, with the laterally elongated head 50 extending in parallel relation to the laterally elongated carrier front side or side wall 25. A mutually supporting relation of the head and carrier is thereby achieved. whereby the head does not move back and forth laterally, relative to the carrier.

Figure 6:
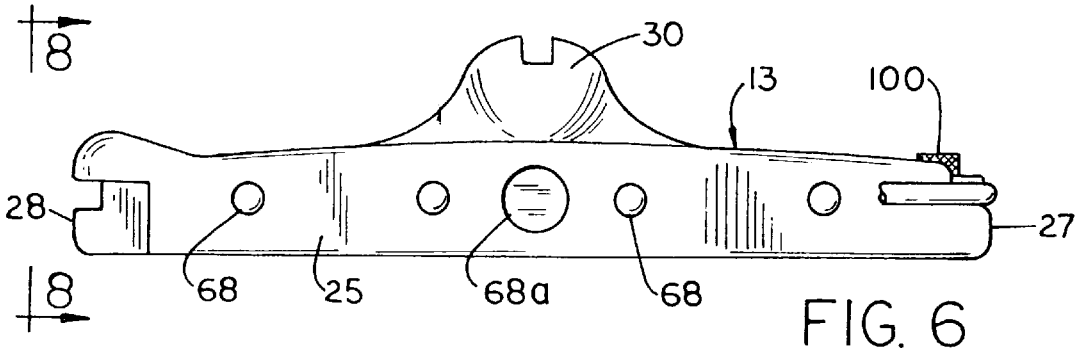
FIG. 6 is a front elevation taken on lines 6—6 of FIG. 5.
Figure 7:
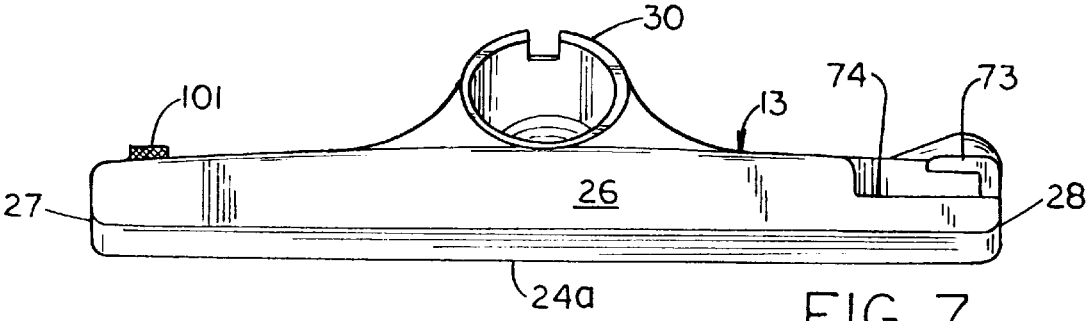
FIG. 7 is a rear elevation taken on lines 7—7 of FIG. 5.
Figure 8:
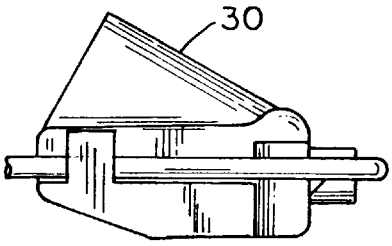
FIG. 8 is an end elevation taken on lines 8—8 of FIG. 6.

Manually adjustable structure is provided for adjustably attaching the mop head to the carrier 13. The adjustable structure includes a retainer bar or bail 65 carried by carrier 13 to adjustably swing about an axis 66, into mop head clamping position, i.e., the position seen in FIG. 1. The bail has turned and pivotal attachment, as at 67, to a post 100 in side opening 67*a* in wall 27 of the carrier 13, whereby bail cross bar 65*a* can be swung outwardly away from front wall 25, allowing the mop head to be fitted over the bar 65*a*, and subsequently swung inwardly to FIG. 1 position. In that position the mop head 50 is clamped between cross bar 65*a* and first wall 25, with multiple forward projections or barbs 68 on the carrier positively engaging and penetrating the mop head to lock it in position. The barbs are also seen in FIG. 6. The head includes a fabric band to be engaged by the barbs. Bar 65*a* clamps the front side of the band, in FIG. 1. See also the larger locater projection 68*a* on the carrier penetrating the centering grommet 70 fixed on the head 50. Multiple lateral point positive locking support of the mop head is thereby achieved, locating it against slippage up or down, or sidewise, from the position shown.

Figure 5:
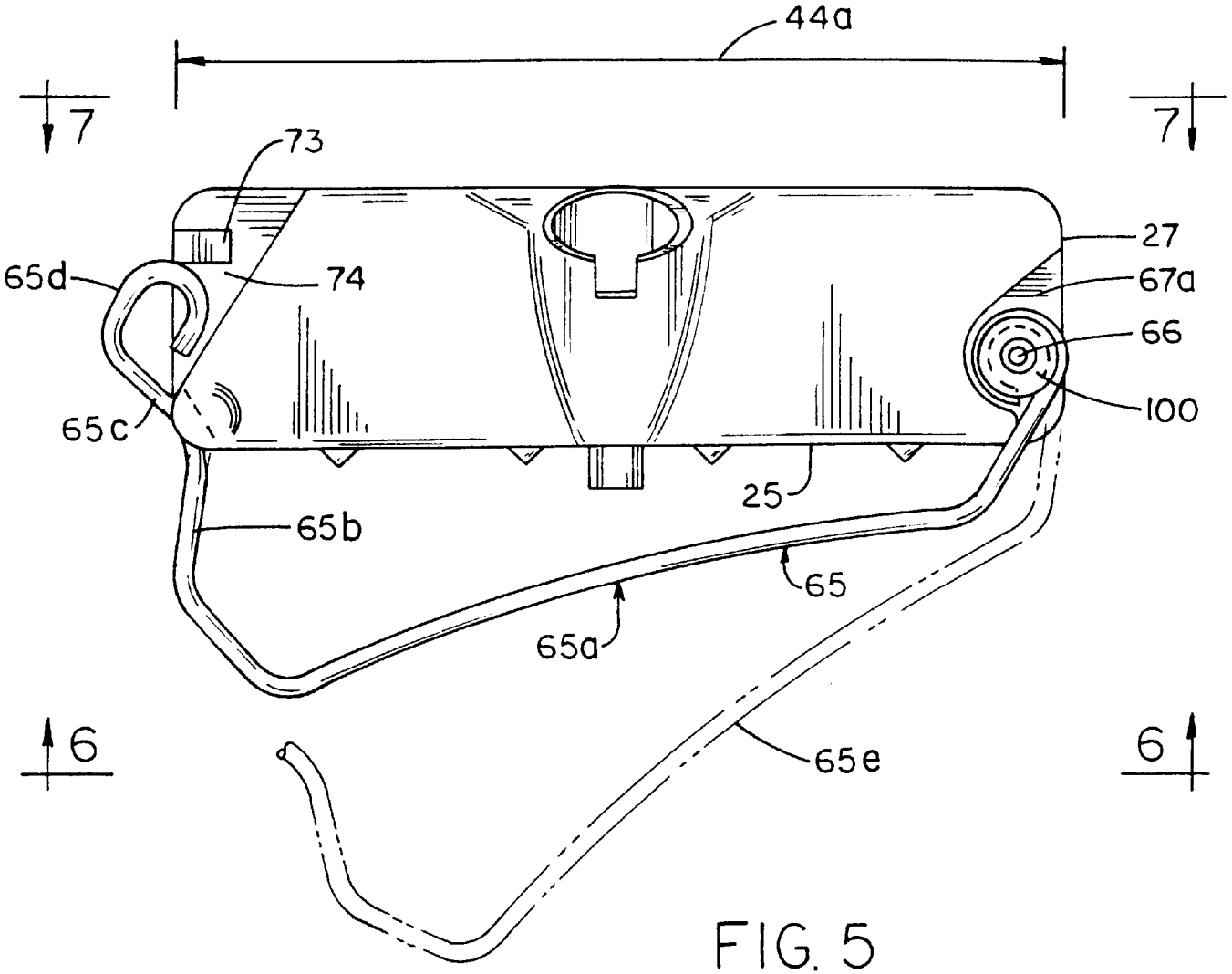
FIG. 5 is a top plan view of a block, and mop retention bar.

FIG. 1 also shows the angled end extent 65*b* of the bar, retained against angle surface portion 28*a* of the block, and reversely angled end extent 65*c* of the bar, retained by a clip 73 on the block. Bar turned end 65*d* serves as a handle. The block end is notched at 74 and accommodates 28*a*, 65*b*, 65*c* and 73. To free the bar and extents 65*b* and 65*c* from locked position, the handle 65*d* is pushed to the right in FIG. 1, to free 65*c* from the U-shaped clip 73, and then raised out of the notch 74, whereby the bar can be pivoted to FIG. 5 position, and to broken line position 65*e*, allowing mop replacement.

Figure 9:
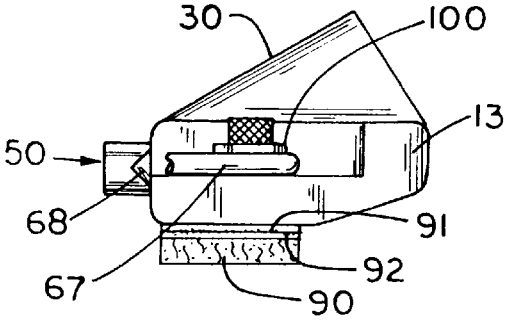
FIG. 9 is an end elevation of a carrier block, showing removable attachment of a scrub pad.

FIG. 9 is like FIG. 1 excepting that a scrubbing 8 pad 90 is substituted for the bristles. A VELCRO attachment of the pad to the underside of the block is shown at 91 and 92. Optimally, the mop may be removed, during scrubbing, or the pad removed during mopping.

Figure 10:
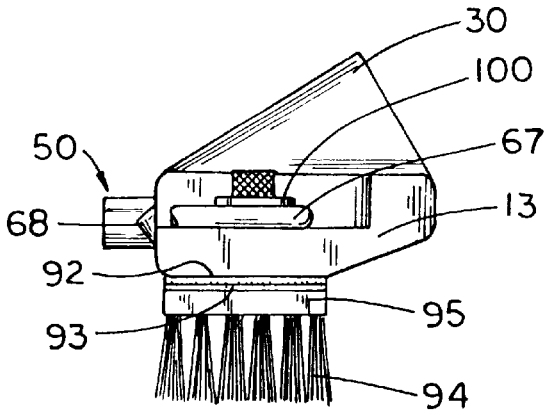
FIG. 10 is an end elevation of a carrier bock showing removable attachment of scrub bristles.

FIG. 10 shows parallel rows of bristles 94 carried by a support 95 attached by VELCRO to the underside of the block 13, as at 92 and 93. Brush structure is thereby provided, at 96.

Figure 11:
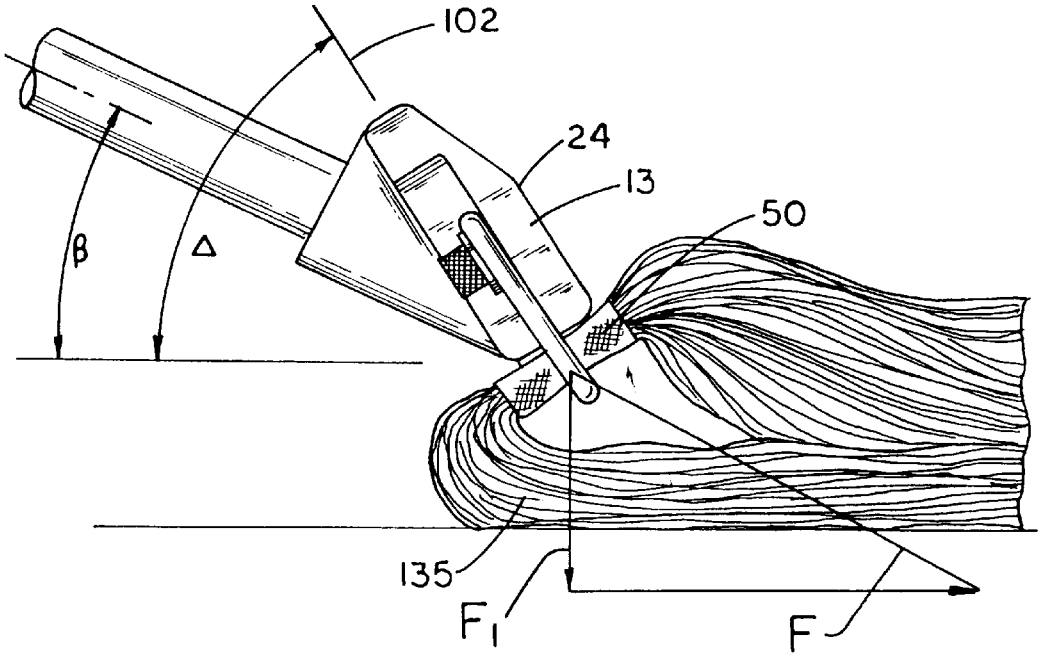
FIG. 11 is a side elevation like FIG. 2, but showing the carrier bock and mop in inverted position.

FIG. 11 shows the capability of the invention for use in inverted position, for scrubbing using the mop itself. Note the exterior angle $\Delta$ of the carrier block or body 13 relative to horizontal, greater than the angle $\beta$ of the inverted handle relative to horizontal. Angle $\Delta$ is formed between horizontal and plane 102 parallel to the underside 24 of block 13. Force is applied, as indicated by force vector F at the inverted mop head, and the downward component of that force is directly applied at $F_1$ downwardly to the inverted mop strands 135, for scrubbing.

We claim:

1. Apparatus for scrubbing and mopping a surface, comprising in combination:

a) a supporting carrier including a block, and scrubbing means carried by the carrier, to project toward the surface for scrubbing that surface, b) first means for attaching an elongated handle to the carrier to extend in a first direction from the carrier, c) a manually manipulable structure for adjustably attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, and to transmit downward force to said scrubbing means, d) said structure including a transversely lengthwise extending bar, about which a portion of the mop extends, e) and there being at least one projection on the carrier for engaging the mop to block bodily movement of said mop portion transversely lengthwise of the bar, f) said mop having a head adjustable attached by said bar to the carrier at a first side of the carrier, said head including a strand retainer to be engaged by said projection, g) a handle, h) and including an upward protrusion on a second side of the carrier, the handle attached to said protrusion and spaced from the mop head.

2. The combination of claim 1 wherein said strand retainer includes a fabric band.

3. The combination of claim 2 wherein there are multiple of said projections transversely spaced apart at said first side of the carrier, to engage said fabric band which clamps the mop strands.

4. The combination of claim 3 including said handle attached to the carrier at a second side thereof spaced from said mop head, and wherein said mop head extends in a lateral direction, and said mop strands extend in a longitudinal direction, whereby a plane extending in said longitudinal direction and passing through said handle also bisects said carrier.

5. The combination of claim 1 wherein said carrier second side faces relatively upwardly, and said carrier first side faces relatively forwardly.

6. The combination of claim 1 wherein said scrubbing means comprises at least one of the following:

i) bristles ii) pad.

7. The combination of claim 6 wherein said bristles include parallel rows of bristles, oriented to receive downward force transmission via the handle and carrier.

8. The combination of claim 1 wherein the block consists of molded plastic material.

9. The combination of claim 1 wherein said scrubbing means has removable attachment to the carrier, and wherein said removable attachment is a VELCRO attachment.

10. The invention of claim 1 wherein said carrier and scrubbing means have an alternate inverted position in which downward force is directly transmissible from the handle and carrier to mop extent under the carrier.

11. Apparatus for scrubbing and mopping a surface, comprising in combination:

a) a supporting carrier including a block, and scrubbing means carried by the carrier, to project toward the surface for scrubbing that surface, b) first means for attaching an elongated handle to the carrier to extend in a first direction from the carrier, c) and manually manipulable structure for adjustably attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, and to transmit downward force to said scrubbing means, d) said structure including a transversely lengthwise extending bar, about which a portion of the mop extends, e) and there being at least one projection on the carrier for engaging the mop to block bodily movement of said mop portion transversely lengthwise of the bar, f) said mop having a head adjustably attached by said bar to the carrier at a first side of the carrier, said head including a strand retainer to be engaged by said projection, g) and wherein said bar has opposite end portions attached to the carrier, one of said end portions being detachable from the carrier to allow installation of the mop on the bar, and removal of the mop from the bar.

12. Apparatus for scrubbing and mopping a surface, comprising in combination:

a) a supporting carrier including a block, and scrubbing means carried by the carrier, to project toward the surface for scrubbing that surface, b) first means for attaching an elongated handle to the carrier to extend in a first direction from the carrier, c) and manually manipulable structure for adjustable attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, and to transmit downward force to said scrubbing means, d) said structure including a transversely lengthwise extending bar, about which a portion of the mop extends, e) and there being at least one projection on the carrier for engaging the mop to block bodily movement of said mop portion transversely lengthwise of the bar, f) said mop having a head adjustably attached by said bar to the carrier at a first side of the carrier, said head including a strand retainer to be engaged by said projection, g) and wherein said bar comprises a bail carried by the carrier to adjustably swing into and out of mop head clamping position.

13. The combination of claim 12 wherein said bail has a releasable locking connection to the carrier to clamp the mop head between the carrier and bail, transversely of the head.

14. Apparatus for scrubbing and mopping a surface, comprising in combination:

a) a supporting carrier including a block, and scrubbing means carried by the carrier, to project toward the surface for scrubbing that surface, b) first means for attaching an elongated handle to the carrier to extend in a first direction from the carrier, c) and manually manipulable structure for adjustable attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, and to transmit downward force to said scrubbing means, d) said structure including a transversely lengthwise extending bar, about which a portion of the mop extends, e) and there being at least one projection on the carrier for engaging the mop to block bodily movement of said mop portion transversely lengthwise of the bar, f) said mop having a head adjustably attached by said bar to the carrier at a first side of the carrier, said head including a strand retainer, g) and wherein said structure includes an adjustable clamp for adjustably clamping the mop head, and having a first position in which the mop head is removable from attachment to the carrier, and a second position in which the mop head is attached to the carrier.

15. The combination of claim 14 wherein said clamp has a part with angled surface attachment to the carrier.

16. The combination of claim 15 wherein said attachment includes a recess formed by the carrier to receive said part, and an angled shoulder on the carrier to be forcibly engaged by said part as said part is received in the recess.

17. The combination of claim 16 wherein the clamp has an end portion having pivoted connection to the carrier, in spaced relation to the recess.

18. The combination of claim 17 wherein said pivoted connection and said recess are located in the block in offset relation to the front side of the block facing the bar.

19. The combination of claim 18 wherein the block consists of molded plastic material, and forms a second recess in which said pivoted connection is located.

20. The combination of claim 14 wherein said structure includes a clamping lever having a rotated position in which said mop head is clamped.

21. Apparatus for scrubbing and mopping a surface, comprising in combination:

a) a supporting carrier, including a block, and scrubbing means carried by the carrier, to project toward the surface for scrubbing that surface, b) first means for attaching an elongated handle to the carrier to extend in a first direction from the carrier, c) a manually adjustable structure for attaching a mop to the carrier with mop strands extending in generally parallel relation with that surface and in mopping contact therewith as the scrubbing means simultaneously engages that surface, for simultaneous mopping and scrubbing of that surface, as the handle extends at an angle to the surface to displace the carrier, scrubbing means and mop parallel to the floor surface, and to transmit downward force to said scrubbing means, d) said structure including a transversely lengthwise extending bar, about which a portion of the mop extends, said bar having opposite end portions attached directly to the carrier, one of said end portions being detachable from the carrier to allow installation of the mop on the bar, and removal of the mop from the bar, e) at least one projection on the carrier for engaging the mop to block bodily movement of said mop portion transversely lengthwise of the bar, said mop having a head adjustably attached by said bar to the carrier at a first side of the carrier, said head including a portion with an opening to be engaged by said projection.

* * * * *